US006109404A

United States Patent [19]

Bishop

[11] Patent Number: 6,109,404

[45] Date of Patent: Aug. 29, 2000

[54] METHOD OF FORMING LIGHTWEIGHT LUGGAGE AND LUGGAGE FORMED BY SAME

[75] Inventor: George Daniel Bishop, Boynton Beach, Fla.

[73] Assignee: AirCase International, Inc., Davie, Fla.

[21] Appl. No.: 09/353,694

[22] Filed: Jul. 14, 1999

[51] Int. Cl.[7] ..... A45C 5/14; A45C 13/02; A45C 13/36; B23P 11/00

[52] U.S. Cl. ..... 190/125; 190/18 A; 190/115; 190/122; 190/127; 29/428

[58] Field of Search ..... 190/24, 122, 39, 190/125, 127, 18 A, 115; 206/523; 29/428

[56] References Cited

U.S. PATENT DOCUMENTS

| | | | |
|---|---|---|---|
| 2,574,089 | 11/1951 | Cochran | 190/125 |
| 3,295,643 | 1/1967 | Peterson et al. | 190/125 X |
| 4,431,041 | 2/1984 | Leiserson | 190/122 X |
| 4,629,040 | 12/1986 | Jones | 190/122 X |
| 5,010,988 | 4/1991 | Brown | 190/125 X |
| 5,065,847 | 11/1991 | Hsieh | 190/125 |
| 5,265,719 | 11/1993 | Wand | 190/125 X |
| 5,295,565 | 3/1994 | Latshaw | 190/24 X |
| 5,474,162 | 12/1995 | Shyr et al. | 190/122 X |
| 5,749,446 | 5/1998 | Hsieh | 190/127 X |
| 5,782,325 | 7/1998 | O'Shea et al. | 190/127 X |
| 5,960,952 | 10/1999 | Chen | 190/125 X |
| 6,021,874 | 2/2000 | Nykoluk | 190/127 X |

FOREIGN PATENT DOCUMENTS

| | | | |
|---|---|---|---|
| 983435 | 2/1976 | Canada | 190/122 |
| 2112816 | 6/1972 | France | 190/127 |
| 2756089 | 6/1979 | Germany | 190/127 |
| 2825325 | 12/1979 | Germany | 190/127 |

*Primary Examiner*—Sue A. Weaver
*Attorney, Agent, or Firm*—Allen, Dyer, Doppelt, Milbrath & Gilchrist, P.A.

[57] ABSTRACT

A method of forming lightweight luggage and luggage formed thereby are provided. The method preferably includes providing an outer frame body. The outer frame body is preferably formed of a foam material and has a pair of spaced-apart, end frame body members and a pair of spaced-apart, side frame body members. Each of the spaced-apart end frame body members is connected to each of the spaced-apart side frame body members along common side peripheries thereof so that the pair of end frame body members and the pair of side frame body members define outer peripheries of a body cavity. Each of the frame body members has a first predetermined width and a first predetermined length. The method also includes positioning a first frame support member to abuttingly contact an inner surface of a first of the pair of end frame body members and positioning a second frame support member to abuttingly contact an inner surface of a second of the pair of end frame body members. The method further includes positioning a frame body support member to abuttingly contact at least the inner surface of each of the pair of the side body members of the outer frame body to reinforcingly support the side body members.

47 Claims, 4 Drawing Sheets

METHOD OF FORMING LIGHTWEIGHT LUGGAGE AND LUGGAGE FORMED BY SAME

FIELD OF THE INVENTION

This invention is related to the luggage industry and, more particularly, to luggage construction and related methods.

BACKGROUND OF THE INVENTION

Various types of luggage have been developed over the years. One of the more popular types of luggage that has been developed is the so-called "wheeled luggage" which has one or more wheels connected to a peripheral edge of a lower end of a piece of luggage and an extendable and retractable handle positioned on a peripheral edge of an upper end of the luggage. A person transporting the luggage can then readily tilt the luggage upon the wheels when positioned upon a support surface and tow the luggage with the extended handle. When transporting the luggage by hand is not a concern, the handle can be retracted and the luggage lifted by one or more auxiliary handles to store the luggage. This type of wheeled luggage is commonly known for carrying clothes and is generally compact for fitting underneath seats and in overhead luggage compartments on airplanes. Examples of frames of such wheeled luggage can be seen in U.S. Pat. Nos. 5,588,512 and 5,685,402 by Lin and each titled "Internal Frame For A Wheeled Suitcase" and U.S. Pat. No. 5,794,744 by Lin titled "Wheeled Luggage Assembly."

Many of these frames for wheeled luggage are bulky, heavy, and difficult to construct. Much of the construction is heavy in efforts to make the luggage durable and strong to withstand the punishment that luggage can take during the transport and handling processes. The frames are often formed of various metals or metal alloys. Although this type of frame construction may be beneficial under some circumstances, it can be difficult to assemble and difficult for owners of the luggage to handle, lift, and use.

SUMMARY OF THE INVENTION

In view of the foregoing, the present invention provides a method of forming lightweight luggage which is durable and strong yet easy to handle, lift, and use by owners of the luggage. The present invention also advantageously provides a method of forming lightweight luggage which is relatively easy to construct, assemble, or manufacture. The present invention also provides a method of forming luggage and luggage formed thereby which readily absorbs shock, is flexible, and is lightweight.

More particularly, a method of forming lightweight luggage according to the present invention preferably includes providing a frame body. The frame body is preferably formed of a closed-cell foam material, e.g., EVA crosslinked foam, and has a pair of spaced-apart, end frame body members and a pair of spaced-apart, side frame body members. Each of the spaced-apart end frame body members is connected to each of the spaced-apart side frame body members along common side peripheries thereof so that the pair of end frame body members and the pair of side frame body members define outer peripheries of a body cavity. Each of the frame body members has a first predetermined width and a first predetermined length. The method also includes positioning a frame body support member to abuttingly contact at least the inner surface of each of the pair of the side body members of the outer frame body to reinforcingly support the side body members. The frame body support member is preferably formed of a plastic material, e.g., ABS plastic, and has at least a pair of side body support members each having a second predetermined width and a second predetermined length. The first predetermined width of the side body members is preferably substantially greater than the second predetermined width of the side support body members, and the first predetermined length of the side body members is preferably substantially the same as the second predetermined length of the side support body members.

Also, the method can advantageously include the frame body having a substantially rectangular shape and having a substantially open rear and front regions to provide access to the body cavity. The method can further include positioning a first frame support member to abuttingly contact an inner surface of a first of the pair of end frame body members and positioning a second frame support member to abuttingly contact an inner surface of a second of the pair of end frame body members. The first and second frame support members are preferably formed of a plastic material. The method can additionally include connecting the frame body support member to the first and second frame support members and to the frame body.

The present invention also advantageously provides a piece of lightweight luggage which includes a frame body. The frame body is preferably formed of a closed-cell foam material and has a pair of spaced-apart, end frame body members and a pair of spaced-apart, side frame body members. Each of the spaced-apart end frame body members is connected to each of the spaced-apart side frame body members along common side peripheries thereof so that the pair of end frame body members and the pair of side frame body members define outer peripheries of a body cavity. Each of the frame body members has a first predetermined width and a first predetermined length. A frame body support member is positioned to abuttingly contact at least the inner surface of each of the pair of the side body members of the outer frame body to reinforcingly support the side body members. The frame body support member is preferably formed of a plastic material and has at least a pair of side body support members each having a second predetermined width and a second predetermined length. The first predetermined width of the side body members is preferably greater than the second predetermined width, and the first predetermined length is preferably substantially the same as the second predetermined length. A flexible frame covering is positioned to at least abuttingly contact each of the outer surfaces of the pair of end frame body members and the pair of side frame body members.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

Figure 1:
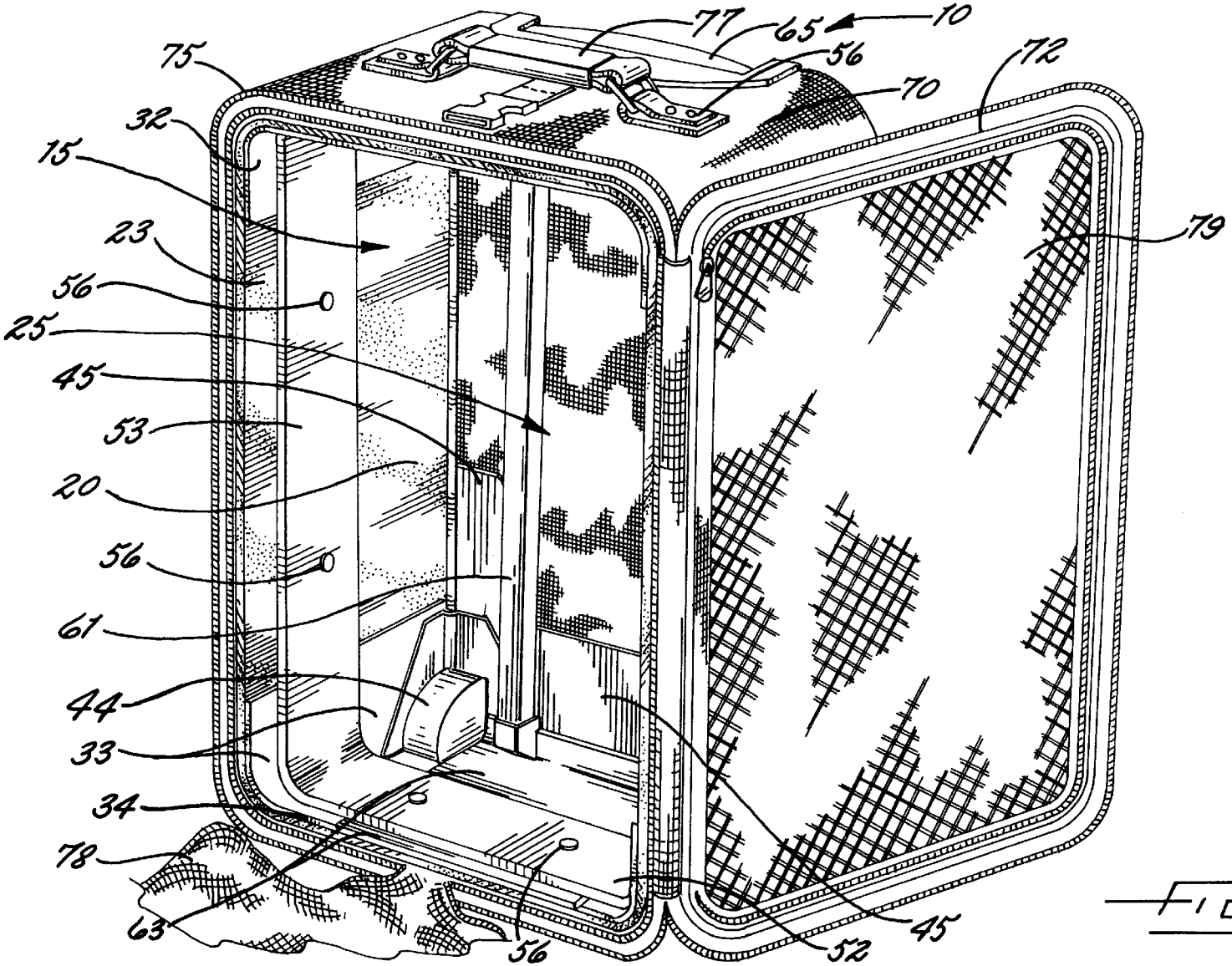
FIG. 1 is a front perspective view of an opened piece of wheeled luggage according to the present invention.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation, if used, indicate similar elements in alternative embodiments.

FIGS. 1–6 illustrate a method of forming lightweight luggage 10 and luggage 10 formed by the same. The lightweight luggage 10 is preferably wheeled luggage, but could also be other forms of luggage as understood by those skilled in the art. As perhaps best illustrated in FIG. 3, a method of forming lightweight luggage 10 preferably includes providing a frame 15 having an upright outer frame body 20. The upright outer frame body 20 is preferably formed of a foam material. The foam material is preferably a closed-cell foam such as an ethylene vinyl acetate ("EVA") crosslinked foam material. This type of foam is particularly advantageous for its lightweight, toughness, durability, good elasticity and compression, and shock absorbing capabilities, especially as compared to open-cell foam products, and thereby enhances the durability and strength due to shock or other handling of luggage made from an EVA foam material.

The upright outer frame body 20 also has a substantially rectangular shape and has an upper 21, a lower 22, and a pair 23, 24 of side frame body members each connected to another member along common side peripheries thereof as illustrated so that the frame body members 21, 22, 23, 24 define outer peripheries of a body cavity 25. The upper and lower frame body members 21, 22 are positioned along the ends of the frame body 20 and generally define end frame body members. Each of the frame body members 21, 22, 23, 24 has a first predetermined width W1 and a first predetermined length L2. The first predetermined width essentially defines the depth of the piece of luggage 10 or body cavity 25 thereof, and the first predetermined length essentially defines the height of the piece of luggage 10 when in the upright position. The outer frame body 20 additionally has substantially open rear and front regions to provide access to the body cavity 25.

The method also preferably includes positioning an upper frame support member 32 to abuttingly contact an inner surface of the upper frame body member 21 and positioning a lower frame support member 34 to abuttingly contact an inner surface of the lower frame body member 22. The upper and lower frame support members 32, 34 are each preferably formed of a plastic material. Each of the upper and lower frame support members 32, 34 also preferably includes respective corner support portions 31, 33 which also abuttingly contact the inner surface of each of the corners of the outer frame body 20 which can often receive additional stress or shock as compared to other portions of the luggage 10. The corner support portions 31, 33 are preferably defined by the connected common side peripheries of the upper, lower, and pair of side frame body members 21, 22, 23, 24 and can even extend along the side frame body members 23, 24 (see FIGS. 1, 3, and 6).

Figures 4, 5, 6:
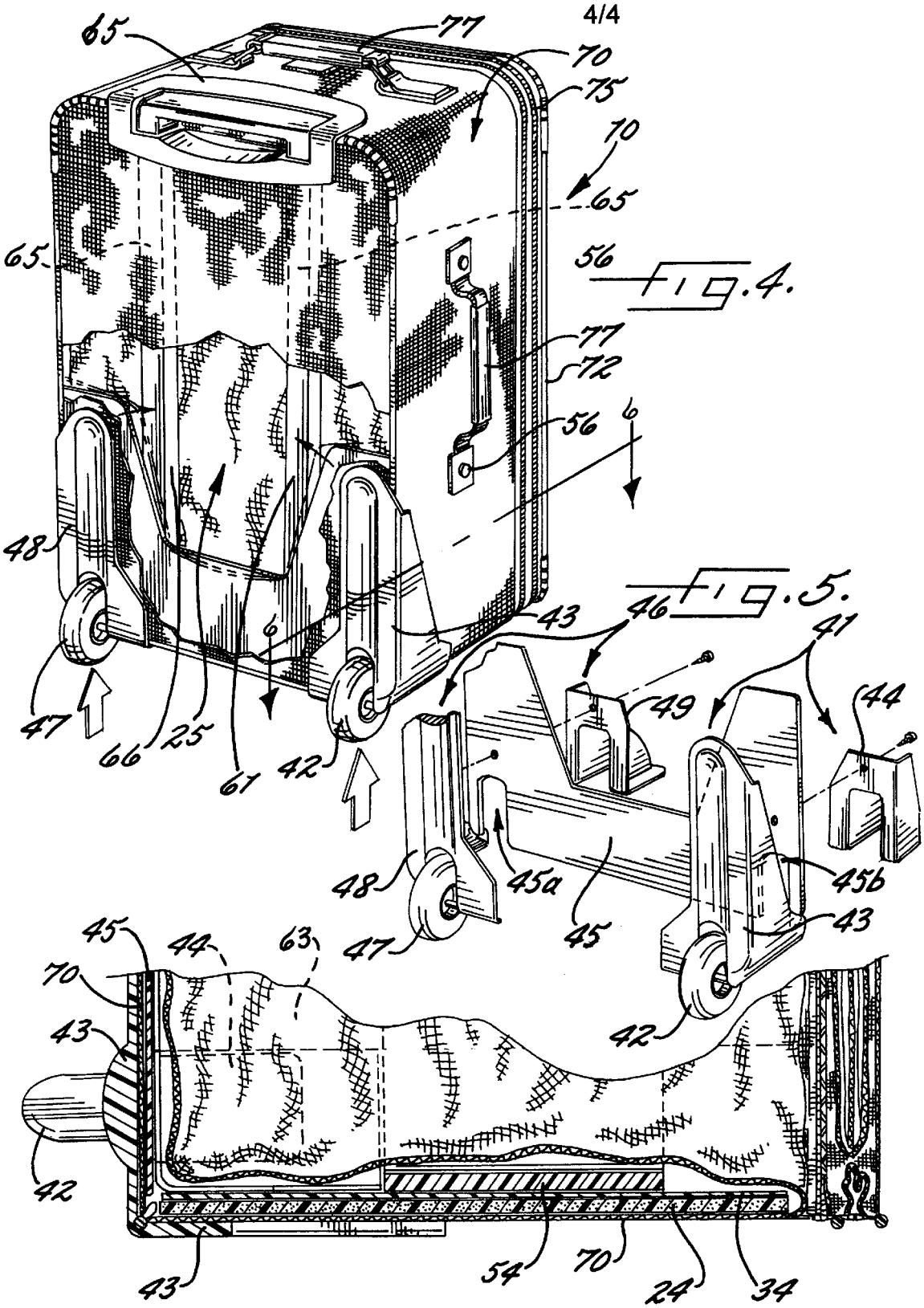
FIG. 4 is a fragmentary rear perspective view of a piece of luggage according to the present invention.
FIG. 5 is an enxploded perspective view of a wheel assembly of a main frame of a piece of luggage according to the present invention.
FIG. 6 is a sectional view of a piece of luggage taken along line 6—6 of FIG. 5 according to the present invention.

The method additionally includes positioning a pair of wheel support inner frame members 41, 46 to abuttingly contact an inner surface of the lower frame body member 22. Each of the pair of wheel support inner frame members 41, 46 is preferably spaced-apart from the other wheel support member. The method can also include connecting each of the pair of wheel support inner frame members 41, 46 to the lower frame body member 22 and also to the lower frame support member 34. The forming and connecting of the wheel support inner frame members 41, 46 to the foam frame body 20 advantageously allows the wheel support inner frame members 41, 46 and wheels 42, 47 respectively connected thereto to absorb or handle shock better than other wheeled luggage designs. A sheet 45 of shaped plastic or foam material, e.g., polyethylene ("PE") as illustrated is preferably connected to the wheel support members 41, 46, to a respective pair of wheel support outer frame members 43, 48, and to a frame covering 70, e.g., along a lower end thereof (see FIGS. 4–6). As illustrated in FIG. 4, the sheet 45 notably flexes as illustrated by the arrows and phantom or dashed lines so that upper extending portions of the sheet 45 flex or move inwardly toward each other and lower medial portions flex downwardly as the wheels 42, 47 move upwardly.

The method further preferably includes positioning a frame body support member 50 to abuttingly contact at least the inner surface of each of the side body members 23, 24 of the outer frame body 20 to reinforcingly support the side body members 23, 24. The frame body support member 50 is also positioned to abuttingly contact the inner surfaces of the upper and lower frame support members 32, 34 as illustrated. The frame body support member 50 also preferably has a substantially rectangular shape as illustrated and is preferably formed of a plastic material. The plastic material of the frame body support member 50 is preferably an acrylonitrile butadiene styrene ("ABS") plastic and preferably has a higher hardness, e.g., as measured by a Rockwell hardness measurement, than the plastic material which forms the upper and lower frame support members 32, 34. The ABS plastic advantageously is easily machined, can be bored or drilled to form openings 55 for ease of connection or assembly to the other members 20, 32, 34 of the luggage 10 which form portions of a luggage frame, and has high rigidity and impact strength, especially as compared to other types of plastics. These advantages of ABS plastic makes it quite suitable for lightweight and yet rugged luggage applications. The frame body support 50 also preferably has an upper, a lower, and a pair of side body support members 51, 52, 53, 54 each connected to another member along common side peripheries thereof as illustrated and each having a second predetermined width W2 and a second predetermined length L2. The first predetermined width W1 of the side body members of the frame body members 21, 22, 23, 24 are preferably substantially greater than the second predetermined width W2 of the side support body members, and the first predetermined length L1 of the side body members is preferably substantially the same as the second predetermined length L2 of the side support body members.

The method can also include connecting the frame body support member 50 to the upper and lower frame support members 32, 34 and to the outer frame body 20, e.g., through bore holes and by the use of fasteners 56, such as rivets, bolts, screws, or other fasteners as understood by those skilled in the art. Notably, the wheel support members 41, 46 are preferably not connected to the frame body support member 50, but rather are connected to the sheet 45 of plastic material, preferably polyethylene ("PE") as described above. This provides greater flexibility to the wheel support members 41, 46 by allowing them to move independently from the body 20.

Figure 2:
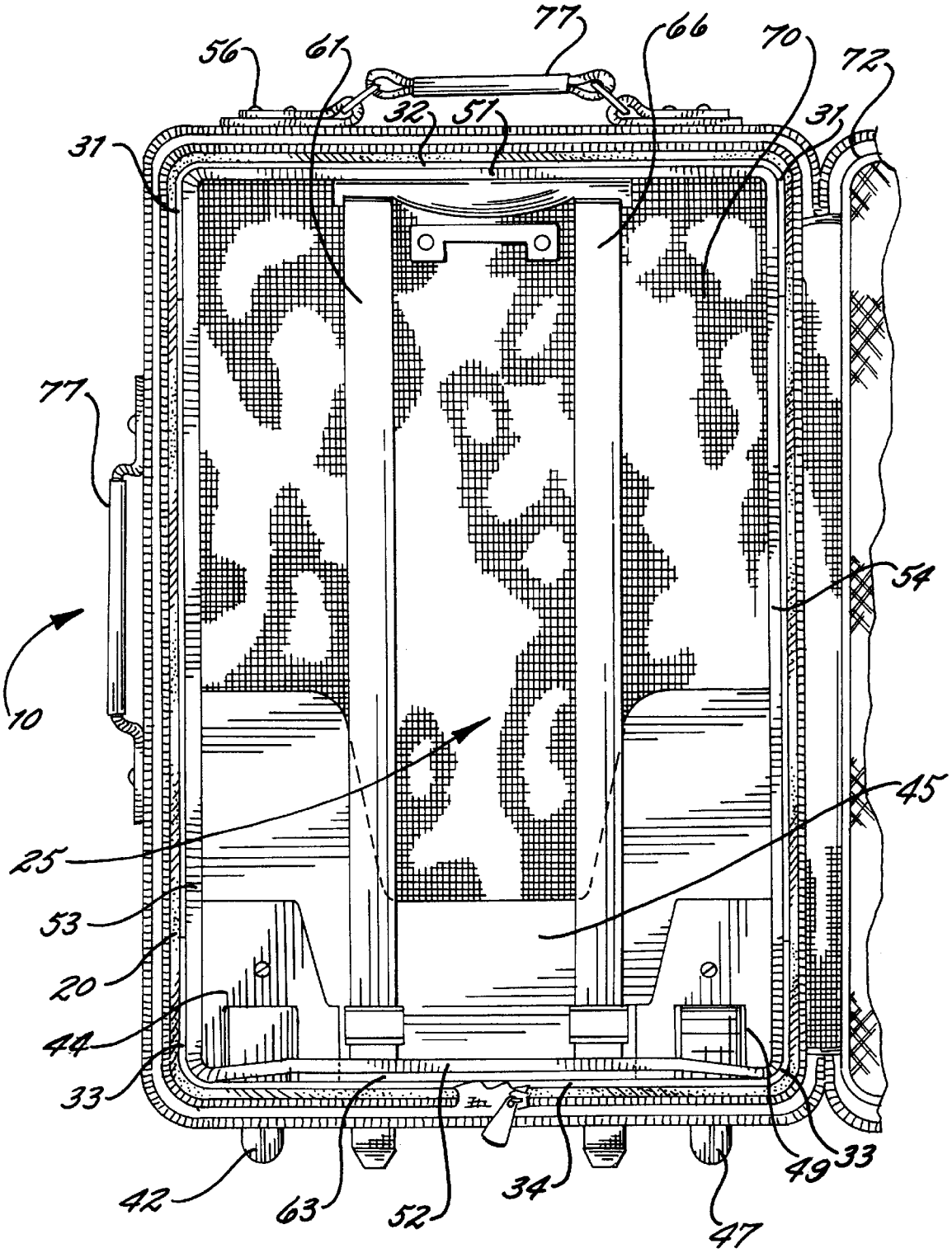
FIG. 2 is a front elevational view of an opened piece of luggage having a main frame and a frame covering positioned thereon according to the present invention.

As perhaps best illustrated in FIGS. 2 and 5, the method further can include positioning a pair of spaced-apart, tubular members 61, 66 to extend between rearward portions of the upper and lower frame body members 21, 22 of the outer frame body 20. Each of the pair of spaced-apart, tubular members 61, 66 is also preferably formed of a plastic material. The method can also include positioning a retractable and extendable handle member 65, e.g., a pair of spaced-apart and generally vertically-extending handle shafts and a generally horizontally-extending handle connected to the shafts, within the pair of tubular members 61, 66 as understood by those skilled in the art and connecting at least one wheel 42, 47 to each of the pair of wheel support frame members 41, 46.

Figure 3:
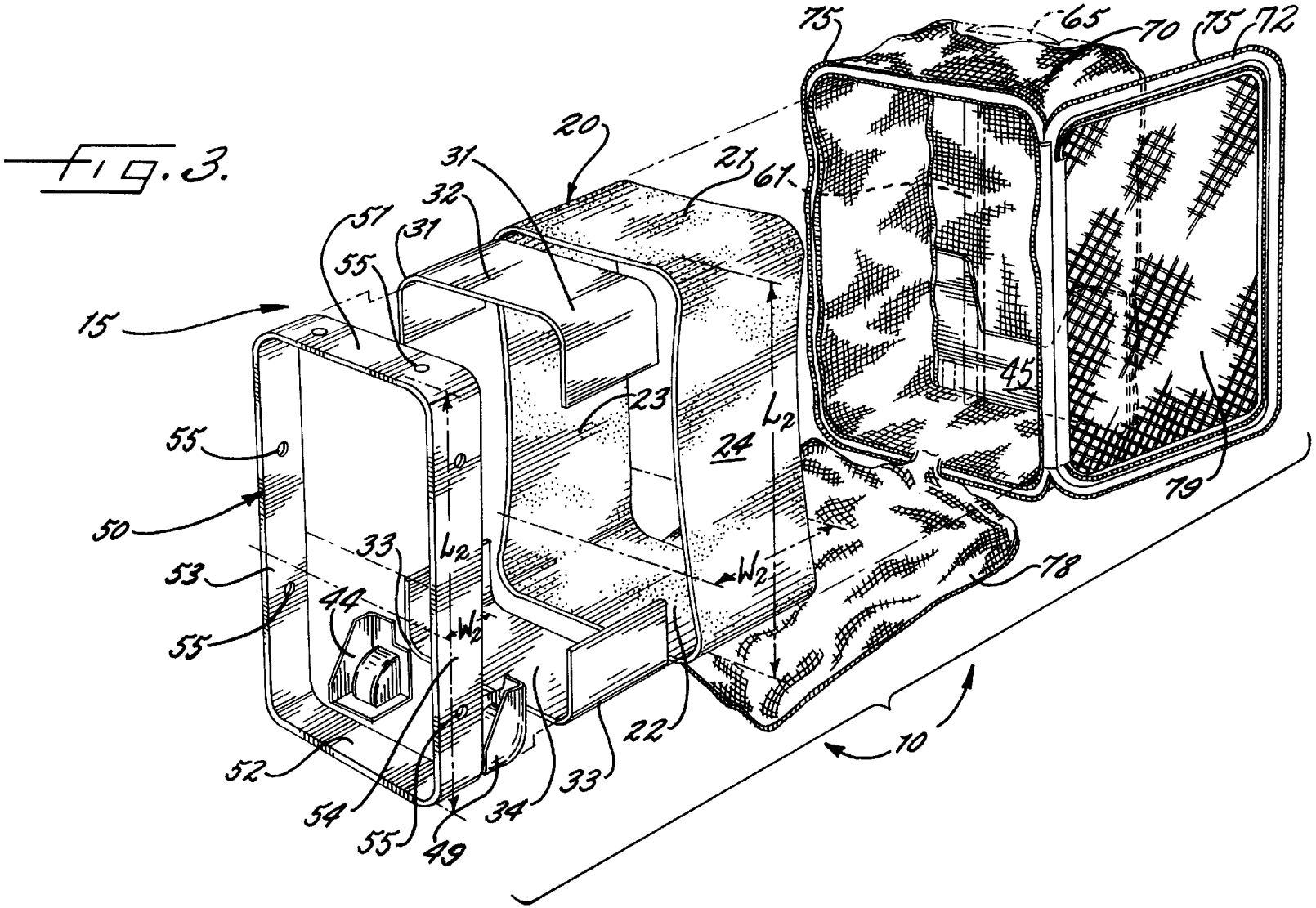
FIG. 3 is an exploded front perspective view of a main frame and a frame covering of a piece of luggage according to the present invention.

The method additionally still preferably includes positioning a frame covering 70 to at least abuttingly contact each of the outer surfaces of the upper, lower, and pair of side frame body members 21, 22, 23, 24. Advantageously, the frame covering 70 is also connected to the frame body support member 50 so that a plurality of bores or openings 55 through the frame body support member 50, the frame body 20, and the upper or lower frame support members 32, 34 also passes through the frame covering 70 to thereby fasten or secure the frame covering 70 to the luggage frame. The frame covering 70 preferably extends over the substantially open rear and front regions of the frame body 20 and over outer surfaces of the frame body 20. The frame covering 70 preferably has a plurality of flexible, but non-retractable handles 77 connected to various desired locations for lifting and handling the luggage 10 and can also include one or more inner and/or outer pockets 79 formed therein. The frame covering 70 further advantageously includes an inner lining 78 having a minor portion which fixedly connects to an outer periphery of the frame covering 70 and can be readily positioned to cover inner surfaces of the frame 15. The inner lining 78 has major portions which detachably connect to the outer peripheries of the frame covering 70 thereby allowing easy assembly, repairs, or general access to the frame 15 as desired. The frame covering 70 also extend over the front region defines a front cover 72 and is openable by a fastener 75, e.g., a zipper (as illustrated in FIGS. 1–3), snaps, hooks and loops, or various other types as understood by those skilled in the art, connected to the frame covering 70 so that ready access to the body cavity 25 by users of the luggage 10 is only or primarily through the front cover 72.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A method of forming lightweight wheeled luggage comprising the steps of:

providing an upright outer frame body, the upright outer frame body being formed of a foam material and having an upper, a lower, and a pair of side frame body members each connected to another member along common side peripheries thereof so that the frame body members define outer peripheries of a body cavity, each of the frame body members having a first predetermined width and a first predetermined length;

positioning an upper frame support member to abuttingly contact an inner surface of the upper frame body member, the upper frame support member being formed of a plastic material;

positioning a lower frame support member to abuttingly contact an inner surface of the lower frame body member, the lower frame support member being formed of a plastic material;

positioning a pair of wheel support frame members to overlie an inner surface of the lower frame support member, each of the pair of wheel support frame members being spaced-apart from the other wheel support member; and positioning a frame body support member to abuttingly contact at least the inner surface of each of the side body members of the outer frame body to reinforcingly support the side body members, the frame body support member being formed of a plastic material and having at least a pair of side body support members each having a second predetermined width and a second predetermined length, the first predetermined width of the side body members being substantially greater than the second predetermined width of the side body support members and the first predetermined length of the side body members being substantially the same as the second predetermined length of the side body support members.

2. A method as defined in claim 1, wherein the outer frame body has a substantially rectangular shape and substantially open rear and front regions to provide access to the body cavity, and wherein the method further comprises the step of connecting the frame body support member to the upper and lower frame support members and to the outer frame body.

3. A method as defined in claim 2, wherein the frame body support member also has a substantially rectangular shape and is also positioned to abuttingly contact the inner surfaces of the upper and lower frame support members.

4. A method as defined in claim 3, wherein each of the upper and lower frame support members includes corner support portions which also abuttingly contact the inner surface of each of the corners of the outer frame body, the corners being defined by the connected common side peripheries of the upper, lower, and pair of side frame body members.

5. A method as defined in claim 4, wherein the foam material of the outer frame body is a closed-cell foam material to thereby enhance durability and strength due to shock or other handling of luggage, and wherein the plastic material of the frame body support member has a higher hardness than the plastic material of the upper and lower frame support members.

6. A method as defined in claim 5, further comprising the step of positioning a pair of tubular members to extend between rearward portions of the upper and lower frame body members of the outer frame body, each of the pair of tubular members being formed of a plastic material.

7. A method as defined in claim 6, further comprising the steps of positioning a retractable and extendable handle member within the pair of tubular members and connecting at least one wheel to each of the pair of wheel support frame members.

8. A method as defined in claim 7, further comprising positioning a frame covering to at least abuttingly contact each of the outer surfaces of the upper, lower, and pair of side frame body members.

9. A method as defined in claim 8, wherein the frame covering extends over the substantially open rear and front regions of the frame body, the frame cover extending over the front region defining a front cover and being openable by a fastener connected to the frame covering so that ready access to the body cavity by users of the luggage is only through the front cover.

10. A method as defined in claim 9, further comprising the step of connecting each of the pair of wheel support frame members to the lower frame body member and also to the lower frame support member.

11. A method of forming lightweight luggage comprising the steps of:

providing an outer frame body, the outer frame body being formed of a foam material and having a pair of spaced-apart, end frame body members and a pair of spaced-apart, side frame body members, each of the spaced-apart end frame body members being connected to each of the spaced-apart side frame body members along common side peripheries thereof so that the pair of end frame body members and the pair of side frame body members define outer peripheries of a body cavity, each of the frame body members having a first predetermined width and a first predetermined length;

positioning a first frame support member to abuttingly contact an inner surface of a first of the pair of end frame body members, the first frame support member being formed of a plastic material;

positioning a second frame support member to abuttingly contact an inner surface of a second of the pair of end frame body members, the second frame support member being formed of a plastic material; and positioning a frame body support member to abuttingly contact at least the inner surface of each of the pair of the side body members of the outer frame body to reinforcingly support the side body members, the frame body support member being formed of a plastic material and having at least a pair of side body support members each having a second predetermined width and a second predetermined length, the first predetermined width of the side body members being substantially greater than the second predetermined width of the side body support members and the first predetermined length of the side body members being substantially the same as the second predetermined length of the side body support members.

12. A method as defined in claim 11, wherein the outer frame body has a substantially rectangular shape and substantially open rear and front regions to provide access to the body cavity, wherein the frame body support member also has a substantially rectangular shape, and wherein the method further comprises the step of connecting the frame body support member to the first and second frame support members and to the outer frame body.

13. A method as defined in claim 12, wherein the frame body support member is also positioned to abuttingly contact the inner surfaces of the first and second frame support members, and wherein the plastic material of the frame body support member has a higher hardness than the plastic material of the first and second frame support members.

14. A method as defined in claim 11, wherein each of the first and second frame support members includes corner support portions which also abuttingly contact the inner surface of each of the corners of the outer frame body, the corners being defined by the connected common side peripheries of the pair of end frame body members and the pair of side frame body members.

15. A method as defined in claim 11, wherein the foam material of the outer frame body is a closed-cell foam material to thereby enhance durability and strength due to shock or other handling of luggage.

16. A method as defined in claim 11, further comprising the step of-positioning a pair of tubular members to extend between rearward portions of the pair of end frame body members of the outer frame-body, each of the pair of tubular members being formed of a plastic material.

17. A method as defined in claim 16, further comprising the steps of positioning a retractable and extendable handle member within the pair of tubular members.

18. A method as defined in claim 17, further comprising positioning a frame covering to at least abuttingly contact each of the outer surfaces of the pair of end frame body members and the pair of side frame body members.

19. A method as defined in claim 18, wherein the frame covering extends over the substantially open rear and front regions of the frame body, the frame cover extending over the front region defining a front cover and being openable by a fastener connected to the frame covering so that ready access to the body cavity by users of the luggage is only through the front cover.

20. A method as defined in claim 19, further comprising the steps of positioning a pair of wheel support frame members to overlie an inner surface of one of the pair of end frame body members, each of the pair of wheel support members being spaced-apart from the other wheel support member, positioning each of the pair of wheel support members also to overlie the second frame support member, and connecting at least one wheel to each of the pair of wheel support frame members.

21. A method of forming lightweight luggage comprising the steps of:

providing a frame body, the frame body being formed of a closed-cell foam material and having a pair of spaced-apart, end frame body members and a pair of spaced-apart, side frame body members, each of the spaced-apart end frame body members being connected to each of the spaced-apart side frame body members along common side peripheries thereof so that the pair of end frame body members and the pair of side frame body members define outer peripheries of a body cavity, each of the frame body members having a first predetermined width and a first predetermined length; and positioning a frame body support member to abuttingly contact at least the inner surface of each of the pair of the side body members of the frame body to reinforcingly support the side body members, the frame body support member being formed of a plastic material and having at least a pair of side body support members each having a second predetermined width and a second predetermined length, the first predetermined width of the side body members being substantially greater than the second predetermined width of the side body support members and the first predetermined length of the side body members being substantially the same as the second predetermined length of the side body support members.

22. A method as defined in claim 21, wherein the frame body has a substantially open rear and front regions to provide access to the body cavity, and wherein the method further comprises the steps of positioning a first frame support member to abuttingly contact an inner surface of a first of the pair of end frame body members, the first frame support member being formed of a plastic material, positioning a second frame support member to abuttingly contact an inner surface of a second of the pair of end frame body members, the second frame support member being formed of a plastic material, and connecting the frame body support member to the first and second frame support members and to the frame body.

23. A method as defined in claim 22, wherein the frame body support member is also positioned to abuttingly contact the inner surfaces of the first and second frame support members, and wherein the plastic material of the frame body support member has a higher hardness than the plastic material of the upper and lower frame support members.

24. A method as defined in claim 23, wherein each of the first and second frame support members includes corner support portions which also abuttingly contact the inner surface of each of the corners of the outer frame body, the corners being defined by the connected common side peripheries of the pair of end frame body members and the pair of side frame body members.

25. A method as defined in claim 24, further comprising the step of positioning a pair of tubular members to extend between rearward portions of the pair of end frame body members of the outer frame body, each of the pair of tubular members being formed of a plastic material.

26. A method as defined in claim 25, further comprising the steps of positioning a retractable and extendable handle member within the pair of tubular members.

27. A method as defined in claim 26, further comprising positioning a frame covering to at least abuttingly contact each of the outer surfaces of the pair of end frame body members and the pair of side frame body members.

28. A method as defined in claim 27, wherein the frame covering extends over the substantially open rear and front regions of the frame body, the frame cover extending over the front region defining a front cover and being openable by a fastener connected to the frame covering so that ready access to the body cavity by users of the luggage is only through the front cover.

29. A method as defined in claim 28, further comprising the steps of positioning a pair of wheel support frame members to overlie contact an inner surface of one of the pair of end frame body members, each of the pair of wheel support members being spaced-apart from the other wheel support member, positioning each of the pair of wheel support members also to overlie the second frame support member, and connecting at least one wheel to each of the pair of wheel support frame members.

30. A piece of lightweight wheeled luggage comprising:

an upright outer frame body, the upright outer frame body being formed of a foam material and having an upper, a lower, and a pair of side frame body members each connected to another member along common side peripheries thereof so that the frame body members define outer peripheries of a body cavity, each of the frame body members having a first predetermined width and a first predetermined length;

an upper frame support member positioned to abuttingly contact an inner surface of the upper frame body member, the upper frame support member being formed of a plastic material;

a lower frame support member positioned to abuttingly contact an inner surface of the lower frame body member, the lower frame support member being formed of a plastic material;

a pair of wheel support frame members positioned to overlie an inner surface of the lower frame support member, each of the pair of wheel support frame members being spaced-apart from the other wheel support member; and a frame body support member positioned to abuttingly contact at least the inner surface of each of the side body members of the outer frame body to reinforcingly support the side body members, the frame body support member being formed of a plastic material and having at least a pair of side body support members each having a second predetermined width and a second predetermined length, the first predetermined width of the side body members being substantially greater than the second predetermined width of the side body support members and the first predetermined length of the side body members being substantially the same as the second predetermined length of the side body support members.

31. A piece of luggage as defined in claim 30, wherein the outer frame body has a substantially rectangular shape and substantially open rear and front regions to provide access to the body cavity, and wherein the frame body support member also has a substantially rectangular shape and is connected to the upper and lower frame support members and to the outer frame body.

32. A piece of luggage as defined in claim 31, wherein the frame body support member is also positioned to abuttingly contact the inner surfaces of the upper and lower frame support members.

33. A piece of luggage as defined in claim 32, wherein each of the upper and lower frame support members includes corner support portions which also abuttingly contact the inner surface of each of the corners of the outer frame body, the corners being defined by the connected common side peripheries of the upper, lower, and pair of side frame body members.

34. A piece of luggage as defined in claim 33, wherein the foam material of the outer frame body is a closed-cell foam material to thereby enhance durability and strength due to shock or other handling of luggage, and wherein the plastic material of the frame body support member has a higher hardness than the plastic material of the upper and lower frame support members.

35. A piece of luggage as defined in claim 34, further comprising a pair of tubular members positioned to extend between rearward portions of the upper and lower frame body members of the outer frame body, each of the pair of tubular members being formed of a plastic material.

36. A piece of luggage as defined in claim 35, further comprising a retractable and extendable handle member positioned within and connected to the pair of tubular members and at least one wheel connected to each of the pair of wheel support frame members.

37. A piece of luggage as defined in claim 36, further comprising positioning a flexible frame covering to at least abuttingly contact each of the outer surfaces of the upper, lower, and pair of side frame body members.

38. A piece of luggage as defined in claim 37, wherein the flexible frame covering extends over the substantially open rear and front regions of the frame body, the frame cover extending over the front region defining a front cover and being openable by a fastener connected to the frame covering so that ready access to the body cavity by users of the luggage is only through the front cover.

39. A piece of luggage as defined in claim 38, further comprising each of the pair of wheel support frame members being connected to a respective one of the upper and lower frame body members and also to one of the frame support members.

40. A piece of lightweight luggage comprising:

a frame body, the frame body being formed of a closed-cell foam material and having a pair of spaced-apart, end frame body members and a pair of spaced-apart, side frame body members, each of the spaced-apart end frame body members being connected to each of the spaced-apart side frame body members along common side peripheries thereof so that the pair of end frame body members and the pair of side frame body members define outer peripheries of a body cavity, each of the frame body members having a first predetermined width and a first predetermined length;

a frame body support member positioned to abuttingly contact at least the inner surface of each of the pair of the side body members of the frame body to reinforcingly support the side body members, the frame body support member being formed of a plastic material and having at least a pair of side body support members each having a second predetermined width and a second predetermined length, the first predetermined width of the side body members being greater than the second predetermined width of the side body support members and the first predetermined length of the side body members being substantially the same as the second predetermined length of the side body support members; and a flexible frame covering positioned to at least abuttingly contact each of the outer surfaces of the pair of end frame body members and the pair of side frame body members.

41. A piece of luggage as defined in claim 40, wherein the frame body has a substantially open rear and front regions to provide access to the body cavity, and wherein the luggage further comprises-a first frame support member positioned to abuttingly contact an inner surface of a first of the pair of end frame body members, the first frame support member being formed of a plastic material, a second frame support member positioned to abuttingly contact an inner surface of a second of the pair of end frame body members, the second frame support member being formed of a plastic material, and wherein the frame body support member is connected to the first and second frame support members and to the frame body.

42. A piece of luggage as defined in claim 41, wherein the frame body support member is also positioned to abuttingly contact the inner surfaces of the first and second frame support members, and wherein the plastic material of the frame body support member has a higher hardness than the plastic material of the upper and lower frame body members.

43. A piece of luggage as defined in claim 41, wherein each of the first and second frame support members includes corner support portions which also abuttingly contact the inner surface of each of the corners of the frame body, the corners being defined by the connected common side peripheries of the pair of end frame body members and the pair of side frame body members.

44. A piece of luggage as defined in claim 41, wherein the frame covering extends over the substantially open rear and front regions of the frame body, the frame cover extending over the front region defining a front cover and being openable by a fastener connected to the frame covering so that ready access to the body cavity by users of the luggage is only through the front cover.

45. A piece of luggage as defined in claim 41, further comprising a pair of wheel support frame members connected to one of the pair of end frame body members and to one of the first and second frame support members, each of the pair of wheel support members being spaced-apart from the other wheel support member, and at least one wheel connected to each of the pair of wheel support frame members.

46. A piece of luggage as defined in claim 40, further comprising a pair of tubular members positioned to extend between rearward portions of the pair of end frame body members of the frame body, each of the pair of tubular members being formed of a plastic material.

47. A piece of luggage as defined in claim 46, further comprising a retractable and extendable handle member positioned within and connected to the pair of tubular members.

* * * * *